US008427270B2

(12) United States Patent
Maeda

(10) Patent No.: US 8,427,270 B2
(45) Date of Patent: Apr. 23, 2013

(54) CHIP-TYPE COIL COMPONENT

(75) Inventor: Tomoyuki Maeda, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/696,472

(22) Filed: Jan. 29, 2010

(65) Prior Publication Data

US 2010/0127812 A1 May 27, 2010

Related U.S. Application Data

(63) Continuation of application No. PCT/JP2008/062494, filed on Jul. 10, 2008.

(30) Foreign Application Priority Data

Jul. 30, 2007 (JP) ..... 2007-197529

(51) Int. Cl.
*H01F 5/00* (2006.01)
*H01F 21/02* (2006.01)
*H01F 27/28* (2006.01)

(52) U.S. Cl.
USPC ..... 336/200; 336/147; 336/186

(58) Field of Classification Search ..... 336/200, 336/147, 222–223, 232; 333/161, 184, 185
See application file for complete search history.

(56) References Cited

U.S. PATENT DOCUMENTS

| | | | | |
|---|---|---|---|---|
| 4,543,553 | A * | 9/1985 | Mandai et al. | 336/83 |
| 5,251,108 | A * | 10/1993 | Doshita | 361/792 |
| 5,629,553 | A * | 5/1997 | Ikeda et al. | 257/531 |
| 6,407,647 | B1 * | 6/2002 | Apel et al. | 333/25 |
| 6,580,350 | B1 * | 6/2003 | Kobayashi | 336/200 |
| 6,922,129 | B2 * | 7/2005 | Aoyagi | 336/200 |
| 7,295,096 | B2 * | 11/2007 | Tamata et al. | 336/200 |
| 2003/0112115 | A1 * | 6/2003 | Yamagata | 336/200 |
| 2006/0055495 | A1 * | 3/2006 | Rategh | 336/200 |
| 2006/0284718 | A1 * | 12/2006 | Baumgartner et al. | 336/223 |

FOREIGN PATENT DOCUMENTS

| | | |
|---|---|---|
| JP | 2-256208 | 10/1990 |
| JP | 4-96814 | 8/1992 |
| JP | 4-134807 | 12/1992 |
| JP | 4-134808 | 12/1992 |
| JP | 8-55725 | 2/1996 |

(Continued)

OTHER PUBLICATIONS

International Search Report; PCT/JP2008/062494; Oct. 14, 2008.

(Continued)

*Primary Examiner* — Mohamad Musleh
*Assistant Examiner* — Mangtin Lian
(74) *Attorney, Agent, or Firm* — Studebaker & Brackett PC; Donald R. Studebaker

(57) ABSTRACT

A chip-type coil component capable of reducing the resistance of the coil while minimizing a decrease in the inductance of the coil includes magnetic layers composed of a multilayer body. The chip-type coil component further includes internal electrodes laminated on the magnetic layers. The internal electrodes are connected to each other to form a coil. The chip-type coil component further includes an auxiliary internal electrode laminated on each of the magnetic layers. Each auxiliary internal electrode is connected in parallel to the internal electrode laminated on the magnetic layer that is different from the magnetic layer on which the auxiliary internal electrode is laminated.

9 Claims, 9 Drawing Sheets

FOREIGN PATENT DOCUMENTS

| | | |
|---|---|---|
| JP | H8-55725 A | 2/1996 |
| JP | 11-150034 | 6/1999 |
| JP | 2001-358016 | 12/2001 |

OTHER PUBLICATIONS

International Preliminary Report on Patentability and Written Opinion of the International Searching Authority with mailing date of Feb. 11, 2010; PCT/JP2008/062494; with English translation.

The First Office Action from the Patent Office of the China State Intellectual Property Office dated May 25, 2011; Chinese Patent Application No. 200880100996.6.

The Office Action from the Taiwan Intellectual Property Office dated May 17, 2012; Taiwan Patent Application No. 97126901; with English summary.

The Preliminary Examination Report from the Taiwan Intellectual Property Office dated Dec. 26, 2011; Taiwanese Patent Application No. 97126901.

* cited by examiner (a)

PRIOR ART (b)

PRIOR ART

CHIP-TYPE COIL COMPONENT

CROSS REFERENCE TO RELATED APPLICATIONS

The present application is a continuation of International Application No. PCT/JP2008/062494, filed Jul. 10, 2008, which claims priority to Japanese Patent Application No. 2007-197529 filed Jul. 30, 2007, the entire contents of each of these applications being incorporated herein by reference in their entirety.

BACKGROUND OF THE INVENTION

1. Field of the Invention

The present invention relates to a chip-type coil component including a coil.

2. Description of the Related Art

A multilayer chip inductor is proposed in Japanese Unexamined Patent Application Publication No. 2001-358016 as a chip-type coil component in related art. The multilayer chip inductor in the related art will now be described with reference to FIG. 9, which shows an exploded perspective view of the multilayer chip inductor.

As shown in FIG. 9, the multilayer chip inductor includes magnetic layers 101 that are deposited on one another. Internal electrodes 102 having the same shape are formed respectively on two adjacent magnetic layers 101. The respective two internal electrodes 102 having the same shape are electrically connected to each other via via-hole conductors 103 at both ends thereof, except the internal electrodes 102 on the outermost layers, which are the top two layers and the bottom two layers. In addition, the internal electrodes 102 are electrically connected in series to each other via the via-hole conductors 103 to form a helical coil L. One end of each of the internal electrodes 102 on the outermost layers, which are the top two layers and the bottom two layers, is formed so as to extend along one end of the corresponding magnetic layer 101 to be connected to an external electrode (not shown). In this multilayer chip inductor, two internal electrodes 102 having the same shape are connected in parallel to each other, and therefore, the resistance of the coil L can be made low.

However, in the above multilayer chip inductor, the magnetic layers 101 on which the internal electrodes 102 having the same shape are formed are deposited in twos, and the axial length of the coil L is increased. Since the inductance of the coil L is in inverse proportion to the axial length, the inductance of the multilayer chip inductor is decreased with the increasing axial length. In addition, since the axial length of the coil L is increased, the number of turns that can be wound per unit length of the coil L is decreased, which prevents the coil L from having a higher inductance.

SUMMARY OF THE INVENTION

The present invention has been developed in view of the above-described problems, and it is an object of the present invention to provide a chip-type coil component capable of reducing the resistance of the coil while minimizing a decrease in the inductance of the coil.

According to preferred embodiments of the present invention, the chip-type coil component of the present invention includes a multilayer body configured by depositing a plurality of insulating layers; a plurality of internal electrodes that are laminated on the insulating layers and are connected to each other to form a coil; and auxiliary internal electrodes laminated on the insulating layers on which the internal electrodes are laminated.

An embodiment of the present invention is characterized in that each of the auxiliary internal electrodes is connected in parallel to the internal electrode laminated on one of the insulating layers that is different from the insulating layer on which the auxiliary internal electrode is laminated.

According to the present invention, since each of the auxiliary internal electrodes is connected in parallel to the internal electrode laminated on one of the insulating layers that is different from the insulating layer on which the auxiliary internal electrode is laminated, the resistance of the coil can be reduced. In addition, since the auxiliary internal electrodes are laminated on the insulating layers on which the internal electrodes are laminated, there is no need to add new insulating layers for the auxiliary internal electrodes. In other words, the provision of the auxiliary internal electrodes does not vary the axial length of the coil. As a result, it is possible to suppress a decrease in the inductance of the coil.

In an embodiment of the present invention, the auxiliary internal electrode and the internal electrode laminated on the same insulating layer may be insulated from each other.

In an embodiment of the present invention, the auxiliary internal electrode and the internal electrode laminated on the same insulating layer may be connected to each other.

In an embodiment of the present invention, the plurality of internal electrodes may be connected to each other via via-hole conductors, and one end of each of the auxiliary internal electrodes may be connected to the internal electrode laminated on one of the insulating layers that is different from the insulating layer on which the auxiliary internal electrode is laminated via a via-hole conductor.

In an embodiment of the present invention, the auxiliary internal electrodes may be arranged in an area where the plurality of internal electrodes are laminated, as viewed from a lamination direction.

In the present invention, each of the auxiliary internal electrodes may be connected to the internal electrode laminated on the insulating layer that is adjacent, in the lamination direction, to the insulating layer on which the auxiliary internal electrode is laminated.

In an embodiment of the present invention, the insulating layers may be magnetic layers.

According to the present invention, since each of the auxiliary internal electrodes is connected in parallel to the internal electrode laminated on one of the insulating layers that is different from the insulating layer on which the auxiliary internal electrode is laminated, it is possible to reduce the resistance of the coil while minimizing a decrease in the inductance of the coil.

Other features, elements, characteristics and advantages of the present invention will become more apparent from the following detailed description of preferred embodiments of the present invention with reference to the attached drawings.

BRIEF DESCRIPTION OF THE DRAWINGS

FIG. 4(*b*) is an equivalent circuit of a chip-type coil component according to an embodiment of the present invention.

DESCRIPTION OF THE PREFERRED EMBODIMENTS

Figure 1:
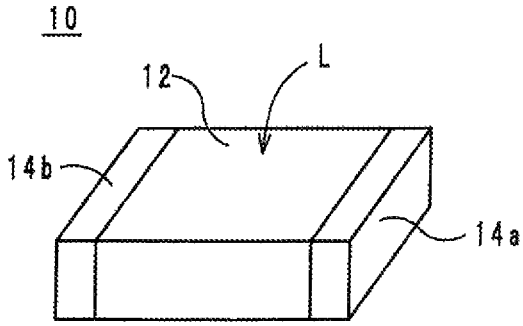
FIG. 1 is an external perspective view of a chip-type coil component according to an embodiment of the present invention.

The structure of a chip-type coil component according to an embodiment of the present invention will herein be described with reference to the attached drawings. FIG. 1 is an external perspective view of a chip-type coil component 10.

Figure 2:
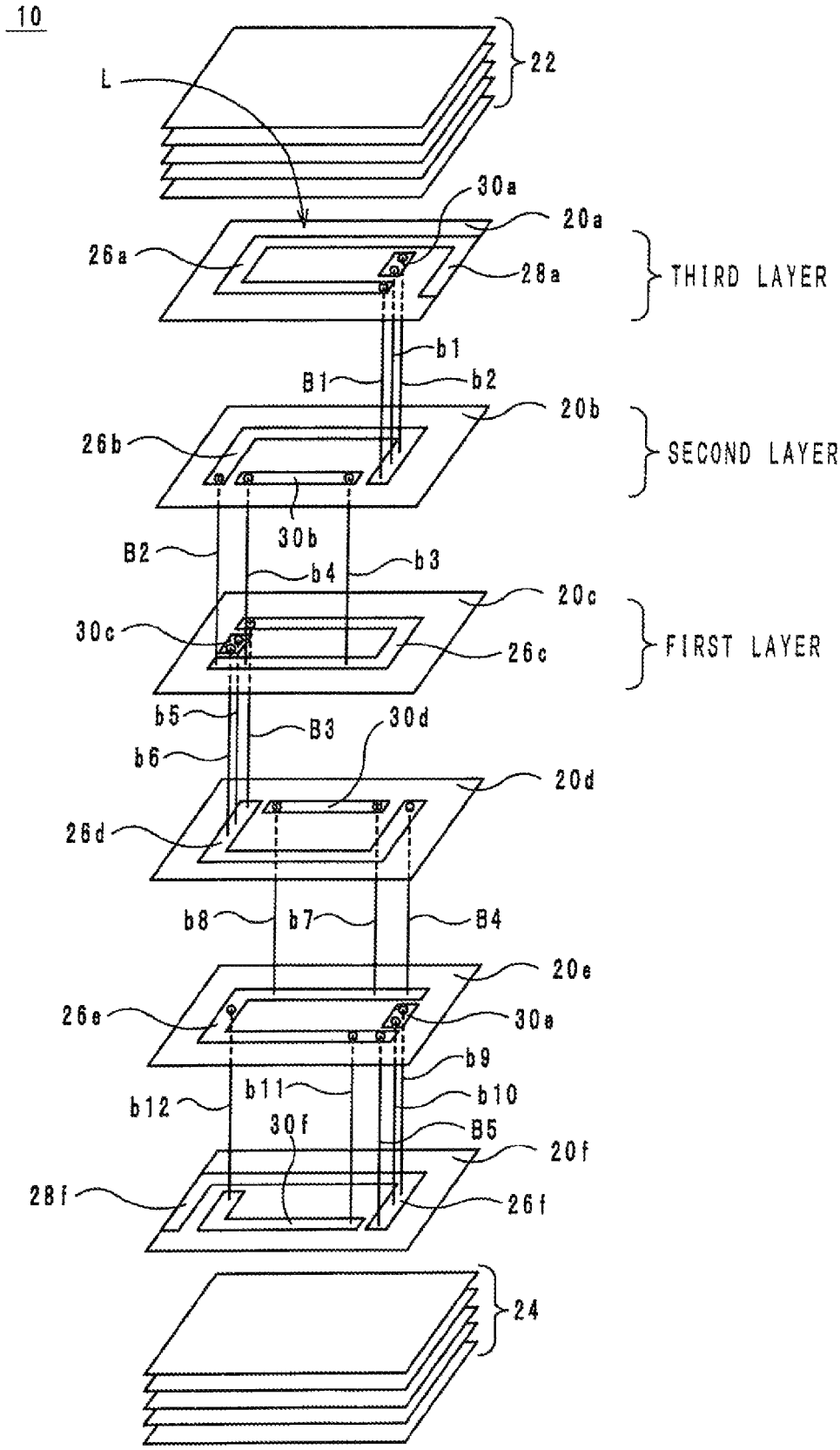
FIG. 2 is an exploded perspective view of the chip-type coil component.

FIG. 2 is an exploded perspective view of the chip-type coil component 10.

In the following description, the lamination direction is defined as the vertical direction. In addition, in the chip-type coil component 10, the top-end face in the lamination direction is called a top face, the bottom-end face of the lamination direction is called a bottom face, and the remaining faces are called side faces.

The chip-type coil component 10 mainly includes a multilayer body 12 and external electrodes 14*a* and 14*b*, as shown in FIG. 1. The multilayer body 12 includes a coil L.

The multilayer body 12 is a rectangular parallelepiped block and is configured by depositing multiple rectangular magnetic layers (insulating layers) 22, 20*a*, 20*b*, 20*c*, 20*d*, 20*e*, 20*f*, and 24, as shown in FIG. 2. Reference letters "a" to "f" are added to reference numeral 20 when the magnetic layers 20 are individually referred to. Only the Reference numeral 20 is used when the magnetic layers 20 are generally referred to. The magnetic layers 20, 22, and 24 are made of a magnetic material. The magnetic material is, for example, Ni—Cu—Zn based ferrite having a permeability of around 130.

The coil L is provided in the multilayer body 12 such that the axis of the coil L extends in the vertical direction. The coil L is configured by laminating internal electrodes 26*a*, 26*b*, 26*c*, 26*d*, 26*e*, and 26*f* on the magnetic layers 20*a*, 20*b*, 20*c*, 20*d*, 20*e*, and 20*f*, respectively, and electrically connecting the internal electrodes 26*a*, 26*b*, 26*c*, 26*d*, 26*e*, and 26*f* in series to each other. Reference letters "a" to "f" are added to reference numeral 26 when the internal electrodes 26 are individually referred to. Only the reference numeral 26 is used when the internal electrodes 26 are generally referred to. Laminating the internal electrodes 26 on the magnetic layers 20 includes transferring the internal electrodes 26 on the magnetic layers 20, in addition to forming the internal electrodes 26 on the magnetic layers 20 by screen printing.

Each of the internal electrodes 26 has a ¾-turn length, and the internal electrodes 26 are electrically connected in series to each other via via-hole conductors B, that is, an end of each of the internal electrodes 26 is connected to the vertically adjacent internal electrode 26 via a via-hole conductor B. More specifically, the internal electrode 26*a* is electrically connected to the internal electrode 26*b* via a via-hole conductor B1, the internal electrode 26*b* is electrically connected to the internal electrode 26*c* via a via-hole conductor B2, the internal electrode 26*c* is electrically connected to the internal electrode 26*d* via a via-hole conductor B3, the internal electrode 26*d* is electrically connected to the internal electrode 26*e* via a via-hole conductor B4, and the internal electrode 26*e* is electrically connected to the internal electrode 26*f* via a via-hole conductor B5. Thereby, the coil L having a helical shape is formed. The ¾ turns indicate that a U-shaped electrode is laminated on a rectangular magnetic layer 20 such that the three sides of the U-shaped electrode extend along three sides, among the four sides, of the rectangular magnetic layer 20.

In addition, the uppermost internal electrode 26*a* includes an extending part 28*a*, and the lowermost internal electrode 26*f* includes an extending part 28*f*. The extending part 28*a* is electrically connected to the external electrode 14*a* shown in FIG. 1. The extending part 28*f* is electrically connected to the external electrode 14*b* shown in FIG. 1. The internal electrodes 26 and the via-hole conductors B are made of, for example, silver.

The external electrodes 14*a* and 14*b* serve as terminals for electrically connecting the coil L to external circuits and are formed on opposing sides of the multilayer body 12. The external electrodes 14*a* and 14*b* are manufactured by, for example, plating a silver electrode with nickel and tin.

In the chip-type coil component 10 according to the present embodiment, auxiliary internal electrodes 30*a*, 30*b*, 30*c*, 30*d*, 30*e*, and 30*f* are provided in order to reduce the resistance of the coil L. Reference letters "a" to "f" are added to reference numeral 30 when the auxiliary internal electrodes 30 are individually referred to. Only the reference numeral 30 is used when the auxiliary internal electrodes 30 are generally referred to. The auxiliary internal electrodes 30 will now be described.

As shown in FIG. 2, each of the auxiliary internal electrodes 30 is laminated in a free area on the magnetic layer 20 on which the internal electrode 26 is laminated and is insulated from the internal electrode 26 laminated on the same magnetic layer 20. However, the auxiliary internal electrode 30 is electrically connected to the internal electrode 26 laminated on the magnetic layer 20 that is different from the magnetic layer 20 on which the auxiliary internal electrode 30 is laminated via via-hole conductors b. Thus, each of the auxiliary internal electrodes 30 is electrically connected in parallel to the internal electrode laminated on the magnetic layer 20 that is vertically adjacent to the magnetic layer 20 on which the auxiliary internal electrode 30 is laminated via two via-hole conductors b.

The connection relationship between the internal electrodes 26 and the auxiliary internal electrodes 30 will now be described in detail.

The auxiliary internal electrode 30*a* is electrically connected in parallel to the internal electrode 26*b* via via-hole conductors b1 and b2. The auxiliary internal electrode 30*b* is electrically connected in parallel to the internal electrode 26*c* via via-hole conductors b3 and b4.

The auxiliary internal electrode 30*c* is electrically connected in parallel to the internal electrode 26*d* via via-hole conductors b5 and b6. The auxiliary internal electrode 30*d* is electrically connected in parallel to the internal electrode 26*e* via via-hole conductors b7 and b8. The auxiliary internal electrode 30*e* is electrically connected in parallel to the internal electrode 26*f* via via-hole conductors b9 and b10. The auxiliary internal electrode 30*f* is electrically connected in parallel to the internal electrode 26*e* via via-hole conductors b11 and b12.

In the chip-type coil component 10, since the auxiliary internal electrodes 30 are connected in parallel to the internal electrodes 26 as described above, the resistance of the coil L can be reduced. In addition, since the auxiliary internal electrodes 30 are laminated in free spaces on the magnetic layers 20 on which the internal electrodes 26 are laminated, there is no need to add new magnetic layers 20 for the auxiliary internal electrodes 30. In other words, the provision of the auxiliary internal electrodes 30 does not vary the axial length of the coil L. As a result, a decrease in the inductance of the coil L is suppressed.

Figure 3:
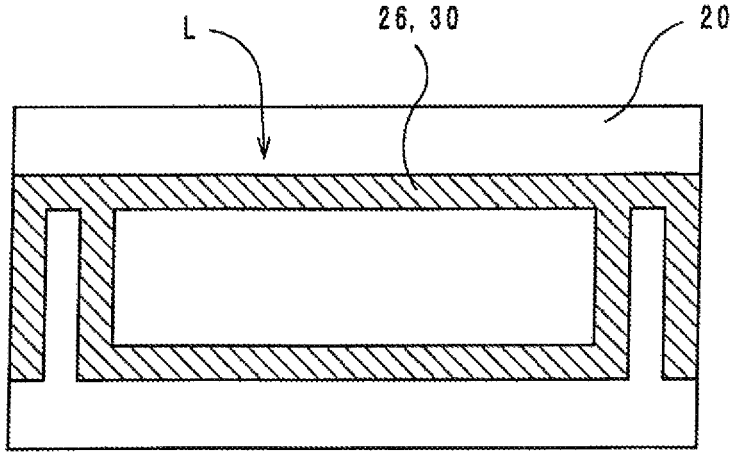
FIG. 3 is a transparent view of the chip-type coil component, viewed from above in a lamination direction.

In addition, the auxiliary internal electrodes 30 are arranged so as to be overlaid on the internal electrodes 26 without protruding from the area where the internal electrodes 26 are formed, in viewed from above, as shown in FIG. 3. FIG. 3 is a transparent view of the chip-type coil component 10, viewed from above. The arrangement of the auxiliary internal electrodes 30 to be overlaid on the internal electrodes 26 causes the coil diameter of the coil L to increase, thus increasing the inductance of the coil L.

Furthermore, since the auxiliary internal electrodes 30 are provided in the chip-type coil component 10, the chip-type coil component 10 has better direct-current superposition characteristics than those of a chip-type coil component without the auxiliary internal electrodes 30. The auxiliary internal electrodes 30 are made of, for example, silver. Since silver is a non-magnetic material, non-magnetic layers are provided between the magnetic layers 20 in the chip-type coil component 10. As a result, the chip-type coil component 10 has better direct-current superposition characteristics than those of a closed-magnetic-circuit-type chip-type coil component without the auxiliary internal electrodes 30.

Figure 9:
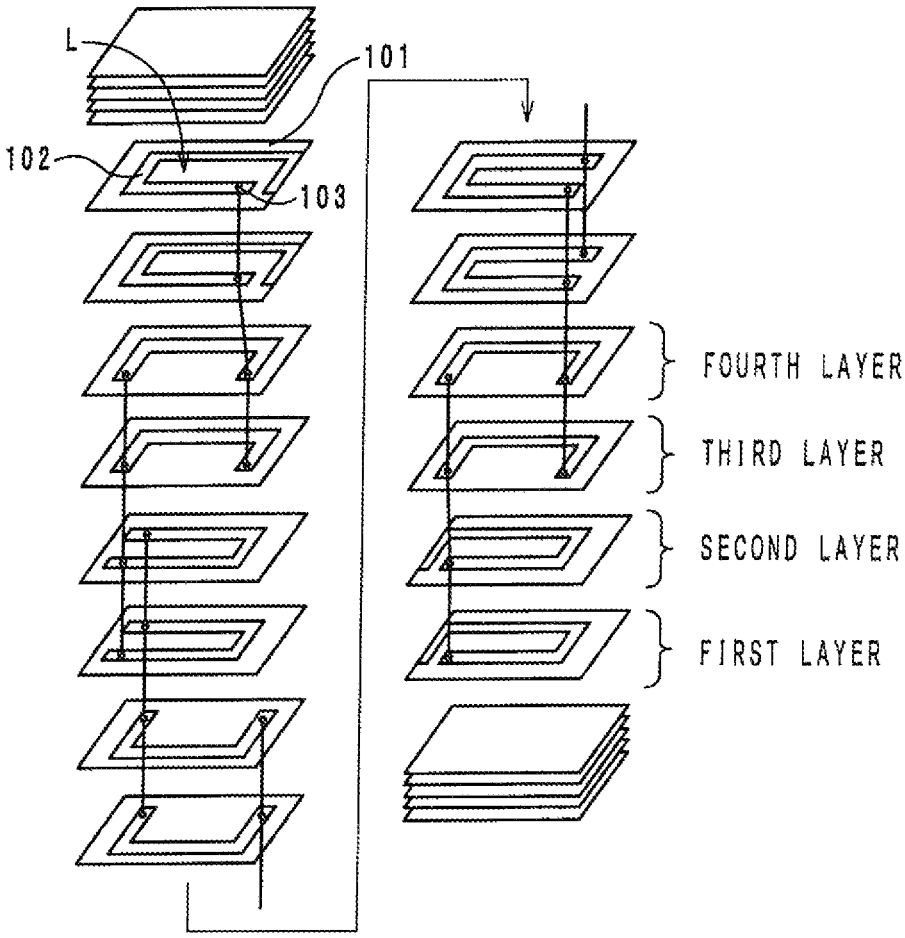
FIG. 9 is an exploded perspective view of a multilayer chip inductor in the related art.

In order to clear the advantages of the chip-type coil component 10, the induction efficiency of the chip-type coil component 10 will now be compared with that of the multilayer chip inductor in the related art shown in FIG. 9. The induction efficiency is defined as a value given by dividing the inductance of a coil by the resistance thereof.

Figure 4:
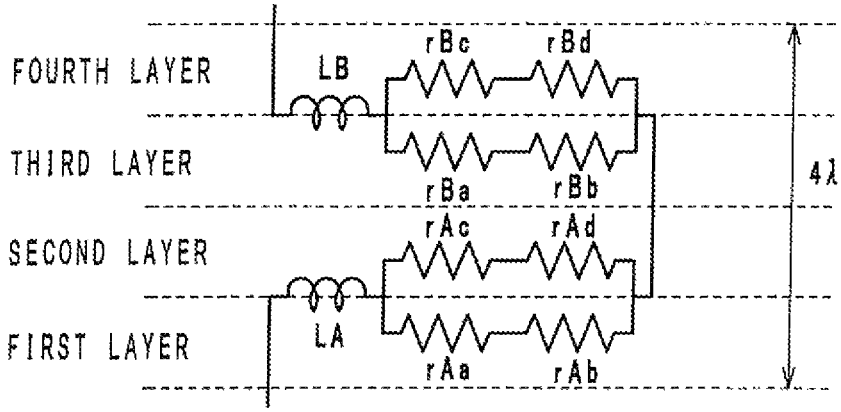
FIG. 4(*a*) is an equivalent circuit of a multilayer chip inductor in related art.
Figure 4:
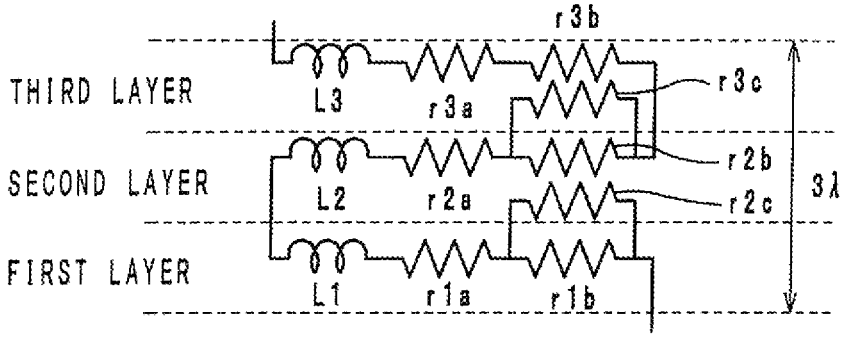

FIG. 4(*a*) is an equivalent circuit of the multilayer chip inductor in the related art shown in FIG. 9. FIG. 4(*b*) is an equivalent circuit of the chip-type coil component 10 shown in FIG. 2. Only four magnetic layers 101 are shown in FIG. 4(*a*), and only three magnetic layers 20 are shown in FIG. 4(*b*). Practically, however, fourteen magnetic layers 101 are practically deposited in the multilayer chip inductor in the related art, and six magnetic layers 20 are deposited in the chip-type coil component 10. However, since the induction efficiency is not varied with the varying number of layers, the equivalent circuits in FIG. 4(*a*) and FIG. 4(*b*) are hereinafter used for comparison in induction efficiency for simplicity.

The correspondence between the equivalent circuit in FIG. 4(*a*) and the multilayer chip inductor in FIG. 9 will now be described.

Reference symbol LA denotes the combined inductance of the internal electrodes 102 laminated on the first magnetic layer 101 and the second magnetic layer 101. The resistance of the internal electrode 102 laminated on the first magnetic layer 101 is defined as rAa+rAb. The resistance of the internal electrode 102 laminated on the second magnetic layer 101 is defined as rAc+rAd.

Reference symbol LB denotes the combined inductance of the internal electrodes 102 laminated on the third magnetic layer 101 and the fourth magnetic layer 101. The resistance of the internal electrode 102 laminated on the third magnetic layer 101 is defined as rBa+rBb. The resistance of the internal electrode 102 laminated on the fourth magnetic layer 101 is defined as rBc+rBd.

Next, the correspondence between the equivalent circuit in FIG. 4(*b*) and the chip-type coil component 10 in FIG. 2 will be described. Reference symbol L1 denotes the inductance of the internal electrode 26 laminated on the first magnetic layer 20. Reference symbol r2*c* denotes the resistance of the auxiliary internal electrode 30 laminated on the second magnetic layer 20. The resistance of the internal electrode 26 laminated on the first magnetic layer 20 is defined as r1*a*+r1*b*. More specifically, reference symbol rib denotes the resistance of the part of the internal electrode 26 to which the auxiliary internal electrode 30 is connected in parallel, and reference symbol r1*a* denotes the resistance of the remaining part of the internal electrode 26.

Reference symbol L2 denotes the inductance of the internal electrode 26 laminated on the second magnetic layer 20. Reference symbol r3*c* denotes the resistance of the auxiliary internal electrode 30 laminated on the third magnetic layer 20. The resistance of the internal electrode 26 laminated on the second magnetic layer 20 is defined as r2A+r2*b*. More specifically, reference symbol r2*b* denotes the resistance of the part of the internal electrode 26 to which the auxiliary internal electrode 30 is connected in parallel, and reference symbol r2*a* denotes the resistance of the remaining part of the internal electrode 26.

Reference symbol L3 denotes the inductance of the internal electrode 26 laminated on the third magnetic layer 20. The resistance of the internal electrode 26 laminated on the third magnetic layer 20 is defined by r3*a*+r3*b*.

It is assumed that Equations (1) and (2) are established in the equivalent circuits having the above configuration.

$$rAa=rAc=rBa=rBc=r1a=r2a=r3a=R1 \quad (1)$$

$$rAb=rAd=rBb=rBd=r1b=r2c=r2b=r3c=r3b=R2 \quad (2)$$

When Equations (1) and (2) are established, the equivalent circuit in FIG. 4(*a*) has a combined resistance RdcI shown by Equation (3), and the equivalent circuit in FIG. 4(*b*) has a combined resistance RdcII shown by Equation (4).

$$RdcI=(R1+R2)/2\times 2=R1+R2 \quad (3)$$

$$RdcII=(R1+R2)+(R1+R2/2)+(R1+R2/2)=3R1+2R2 \quad (4)$$

The inductance is in proportion to a square of the number of windings of the coil and is in reverse proportion to the axial length of the coil. Accordingly, the equivalent circuit in FIG. 4(*a*) has an inductance LI shown by Equation (5), and the equivalent circuit in FIG. 4(*b*) has an inductance LII shown by Equation (6).

$$LI=\alpha\cdot(2N)^2/4\lambda=\alpha\cdot N^2/\lambda \quad (5)$$

$$LII=\alpha\cdot(3N)^2/3\lambda=\alpha\cdot 3N^2/\lambda \quad (6)$$

In Equations (5) and (6), a denotes a coefficient. The axial length and the number of windings of the coil shown in equivalent circuit in FIG. 4(*a*) are denoted by 4λ and 2N, respectively, and the axial length and the number of windings of the coil shown in equivalent circuit in FIG. 4(*b*) are denoted by 3λ and 3N, respectively. N denotes the length (the number of turns) (for example, ¾ turns) of the internal electrode on one layer.

On the basis of Equations (3) to (6), the equivalent circuit in FIG. 4(*a*) has an induction efficiency X1 shown by Equation (7), and the equivalent circuit in FIG. 4(*b*) has an induction efficiency X2 shown by Equation (8).

$$X1=\alpha\cdot N^2/[\lambda(R1+R2)] \quad (7)$$

$$X2=\alpha 19\ 3N^2/[\lambda(3R1+2R2)] \quad (8)$$

According to Equations (7) and (8), X1<X2. Consequently, the chip-type coil component 10 according to the present embodiment has an induction efficiency higher than that of the multilayer chip inductor in the related art in FIG. 9.

Figure 5:
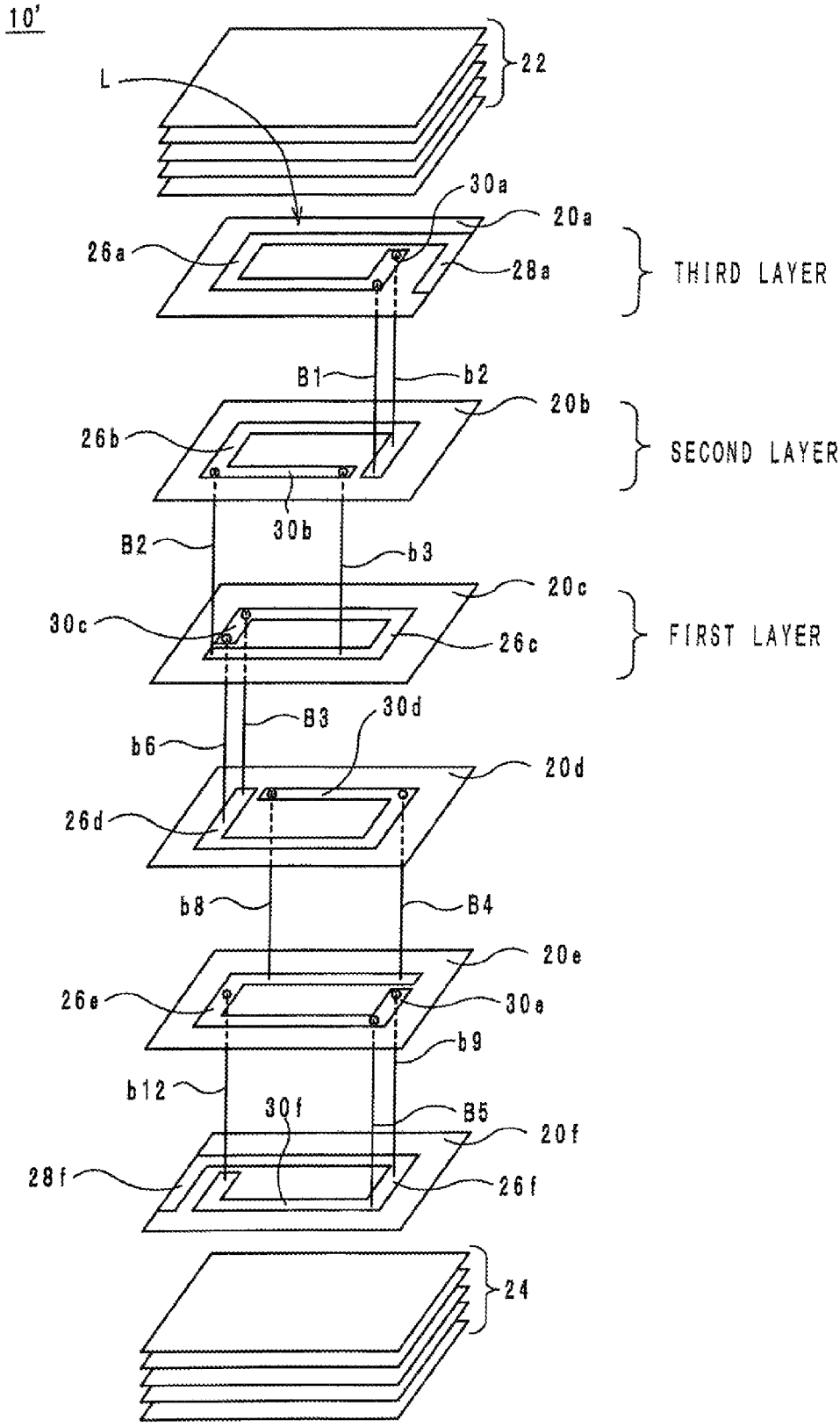
FIG. 5 is an exploded perspective view of a chip-type coil component according to a first modification.

FIG. 5 is an exploded perspective view of a chip-type coil component 10' according to a first modification. The same reference symbols are used in FIG. 5 to identify the components corresponding to the components in FIG. 2. The difference between the chip-type coil component 10' according to the first modification and the chip-type coil component 10 shown in FIG. 2 is focused in the following description.

In the chip-type coil component 10' according to the first modification, the internal electrode 26 and the auxiliary internal electrode 30 laminated on the same magnetic layer 20 are connected to each other. In addition, one end of each of the auxiliary internal electrodes 30 is connected to the internal electrode 26 laminated on the magnetic layer 20 different from the magnetic layer 20 on which the auxiliary internal electrode 30 is laminated via a via-hole conductor B for connecting the internal electrodes 26 to each other. Specifically, the auxiliary internal electrode 30*a* is connected to the internal electrode 26*b* via a via-hole conductor B1, instead of the via-hole conductor b1.

The auxiliary internal electrode 30*b* is connected to the internal electrode 26*c* via a via-hole conductor B2, instead of the via-hole conductor b4. The auxiliary internal electrode 30*c* is connected to the internal electrode 26*d* via a via-hole conductor B3, instead of the via-hole conductor b5. The auxiliary internal electrode 30*d* is connected to the internal electrode 26*e* via a via-hole conductor B4, instead of the via-hole conductor b7. The auxiliary internal electrode 30*e* is connected to the internal electrode 26*f* via a via-hole conductor B5, instead of the via-hole conductor b10. The other end of the auxiliary internal electrode 30 is connected to the internal electrode 26 via a via-hole conductor b.

In addition, the auxiliary internal electrode 30*f* laminated on the magnetic layer 20*f* is connected to the internal electrode 26*f* and is connected to the internal electrode 26*e* via the via-hole conductor B5, instead of the via-hole conductor b11.

In the chip-type coil component 10' according to the first modification described above, since the via-hole conductors B for connecting the internal electrodes 26 to each other are used as the via-hole conductors for connecting the auxiliary internal electrodes 30 to the internal electrodes 26 in parallel, the total number of via-hole conductors b can be reduced. Consequently, it is possible to improve the productivity and reduce the manufacturing cost of the chip-type coil component 10'.

In addition, the length of the part where each of the internal electrodes 26 is connected in parallel to the auxiliary internal electrode 30 in the chip-type coil component 10' according to the first modification is greater than that in the chip-type coil component 10 shown in FIG. 2. Accordingly, the resistances r1*b*, r2*b*, r2*c*, and r3*c* in the chip-type coil component 10' according to the first modification are greater than the resistances r1*b*, r2*b*, r2*c*, and r3*c* in the chip-type coil component 10 shown in FIG. 2.

In contrast, the resistances r1*a* and r2*a* in the chip-type coil component 10' according to the first modification are smaller than the resistances r1*a* and r2*a* in the chip-type coil component 10 shown in FIG. 2. The amount by which the chip-type coil component 10' is greater than the chip-type coil component 10 in the total of the resistances r1*b*, rb2, r2*c* and r3*c* (in the combined resistance of the parts where the internal electrodes 26 are connected in parallel to the auxiliary internal electrodes 30) is smaller than the amount by which the chip-type coil component 10' is smaller than the chip-type coil component 10 in the resistances r1*a* and r2*a* (in the resistances of the remaining parts). As a result, the resistance RdcII of the chip-type coil component 10' according to the first modification is smaller than the resistance RdcII of the chip-type coil component 10 shown in FIG. 2.

Furthermore, as in the chip-type coil component 10, since the auxiliary internal electrodes 30 are provided in the chip-type coil component 10', the chip-type coil component 10' has better direct-current superposition characteristics than those of a chip-type coil component without the auxiliary internal electrodes 30.

Figure 6:
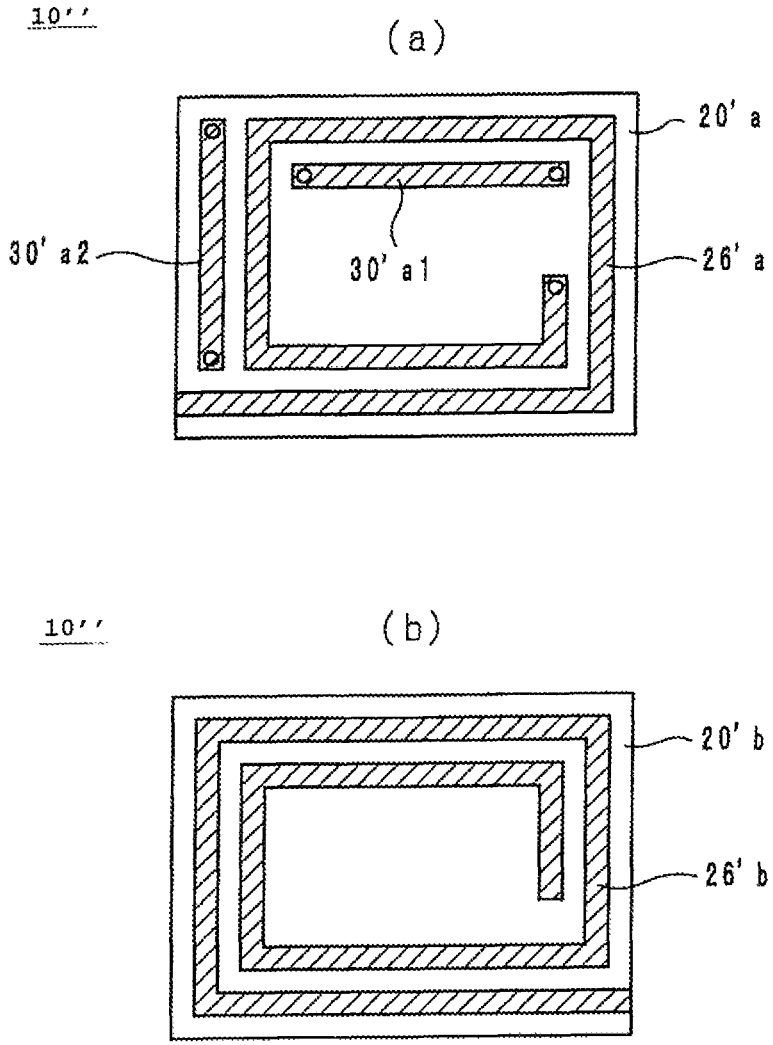
FIG. 6*a* is a diagram showing the structure of magnetic layers, internal electrodes, and auxiliary internal electrodes in a chip-type coil component according to a second modification.
FIG. 6*b* is another diagram showing the structure of magnetic layers, internal electrodes, and auxiliary internal electrodes in a chip-type coil component according to a second modification.

FIGS. 6*a* and 6*b* are diagrams showing the structure of magnetic layers 20'*a* and 20'*b*, internal electrodes 26'*a* and 26'*b*, and auxiliary internal electrodes 30'*a*1 and 30'*a*2 in a chip-type coil component 10" according to a second modification.

As shown in FIGS. 6*a* and 6*b*, each of the internal electrodes 26'*a* and 26'*b* is in a spiral shape. The two auxiliary internal electrodes 30'*a*1 and 30'*a*2 are laminated on the same magnetic layer 20'*a*. The auxiliary internal electrodes 30'*a*1 and 30'*a*2 are connected to the internal electrode 26'*b* laminated on the magnetic layer 20'*b*, which is different from the magnetic layer 20'*a* on which the auxiliary internal electrodes 30'*a*1 and 30'*a*2 are laminated, via via-hole conductors.

When the internal electrodes 26' are provided on three or more layers, the auxiliary internal electrodes 30'*a*1 and 30'*a*2 may be connected to different internal electrodes 26'. Specifically, the auxiliary internal electrode 30'*a*1 may be connected to the internal electrode 26' laminated on the magnetic layer 20' that is arranged above the magnetic layer 20' on which the auxiliary internal electrode 30'*a*1 is laminated, and the auxiliary internal electrode 30'*a*2 may be connected to the internal electrode 26' laminated on the magnetic layer 20' that is arranged below the magnetic layer 20' on which the auxiliary internal electrode 30'*a*2 is laminated.

The chip-type coil component 10" also has better direct-current superposition characteristics than those of a chip-type coil component without the auxiliary internal electrodes 30', as in the chip-type coil component 10.

Although each of the auxiliary internal electrodes 30 is electrically connected in parallel to the internal electrode 26 laminated on the magnetic layer 20 that is vertically adjacent to the magnetic layer 20 on which the auxiliary internal electrode 30 is laminated via two via-hole conductors b, the connection between the auxiliary internal electrodes 30 and the internal electrodes 26 may be made in other ways. As an example, each of the auxiliary internal electrodes 30 may be connected to an internal electrode 26 other than the internal electrode 26 laminated on the magnetic layer 20 that is vertically adjacent to the magnetic layer 20 on which the auxiliary internal electrode 30 is laminated.

Although the arrangement wherein the auxiliary internal electrodes 30 are overlaid on the internal electrodes 26, viewed from above, is exemplified, the auxiliary internal electrodes 30 may be arranged so as to protrude from the area where the internal electrodes 26 are formed.

In the chip-type coil components 10 and 10', some of the magnetic layers 20 may be replaced with non-magnetic layers. In this case, the direct-current superposition characteristics of the coil L are improved.

Insulating layers made of polyimide etc. may be used in the chip-type coil components 10, 10', and 10", instead of the magnetic layers 20, 22, and 24.

The inventor conducted first and second experiments described below in order to clear the advantages of the chip-type coil components 10, 10', and 10".

In the first experiment, in order to indicate an improvement in the induction efficiency of the chip-type coil component 10 due to the auxiliary internal electrodes 30, a chip-type coil component without the auxiliary internal electrodes 30 laminated therein (i.e., a first prototype) and the chip-type coil component 10 with the auxiliary internal electrodes 30 laminated therein (i.e., a second prototype) were created, and the inductances, the resistances, and the induction efficiencies of the first prototype and the second prototype were measured.

First, the created chip-type coil components will be described. The first prototype and the second prototype have the following structures. The first prototype and the second prototype differ only in that the second prototype has the auxiliary internal electrodes 30.

Size: 2.00 mm×1.25 mm×0.85 mm

Material of magnetic layers: Ni—Cu—Zn based ferrite

Permeability of magnetic layers: 130

Material of external electrodes: silver plated with nickel and tin

Material of internal electrodes and auxiliary internal electrodes: silver

Length of internal electrodes: ¾ turns

The number of turns of coil L: 6.5 turns

Table 1 shows the inductances, the resistances, and the induction efficiencies of the first prototype and the second prototype having the above structures.

TABLE 1

| | First prototype | Second prototype |
|---|---|---|
| Inductance (μH) | 3.49 | 3.45 |
| Resistance (Ω) | 0.191 | 0.163 |
| Induction Efficiency (μH/Ω) | 18.2 | 21.1 |

Table 1 shows that the inductance of the second prototype, which has the laminated auxiliary internal electrodes 30, was slightly lower than the inductance of the first prototype. However, Table 1 also shows that the resistance of the second prototype was greatly lower than the resistance of the first prototype. As a result, it is found that the induction efficiency of the second prototype was greatly improved, compared with the induction efficiency of the first prototype. Accordingly, it is found that the provision of the auxiliary internal electrodes 30 improved the induction efficiency of the chip-type coil component 10. In addition, according to the first experiment, it is supposed that the provision of the auxiliary internal electrodes 30 improves the induction efficiency also in the chip-type coil components 10' and 10", as in the chip-type coil component 10.

Figure 7:
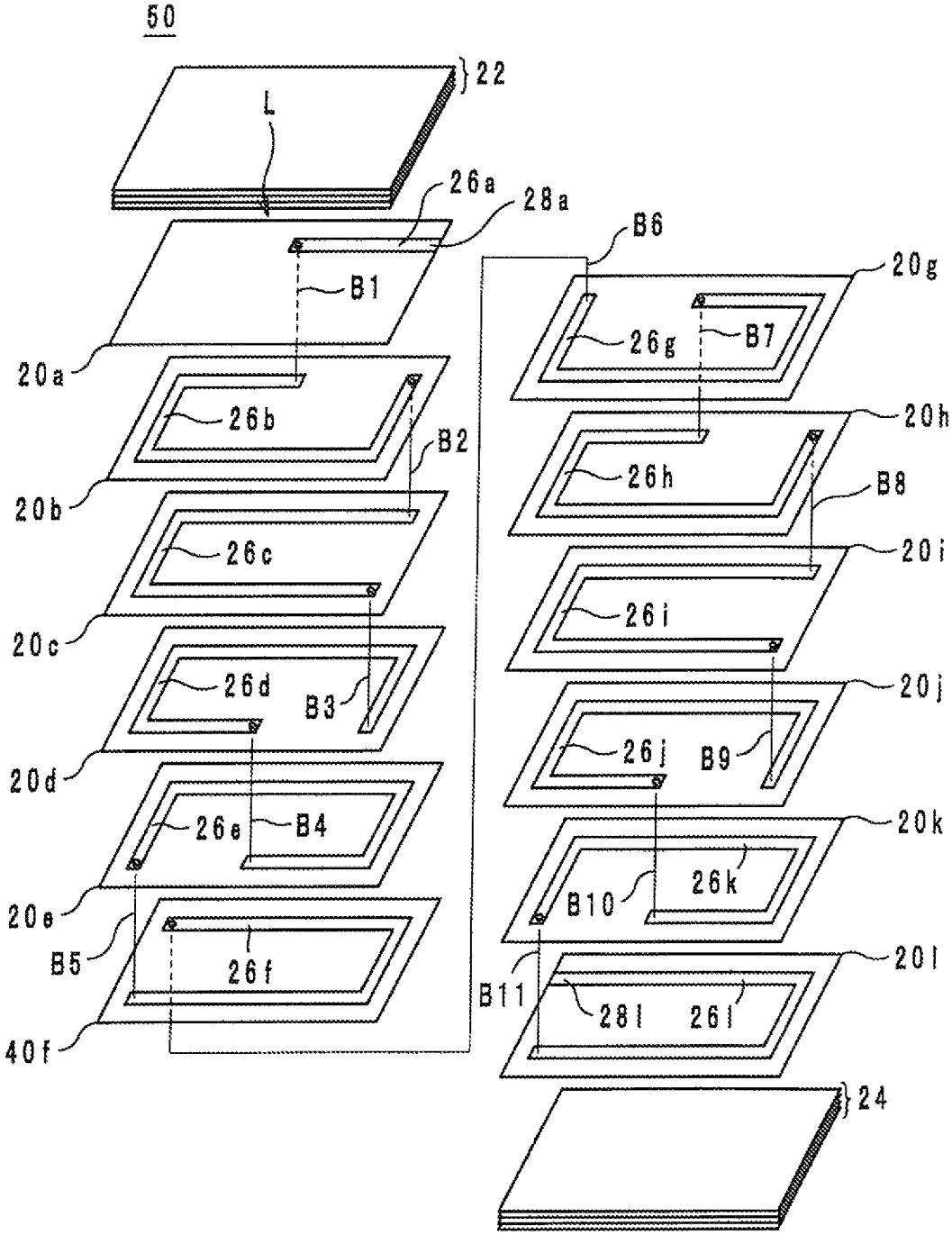
FIG. 7 is an exploded perspective view of a third prototype manufactured in a second experiment.
Figure 8:
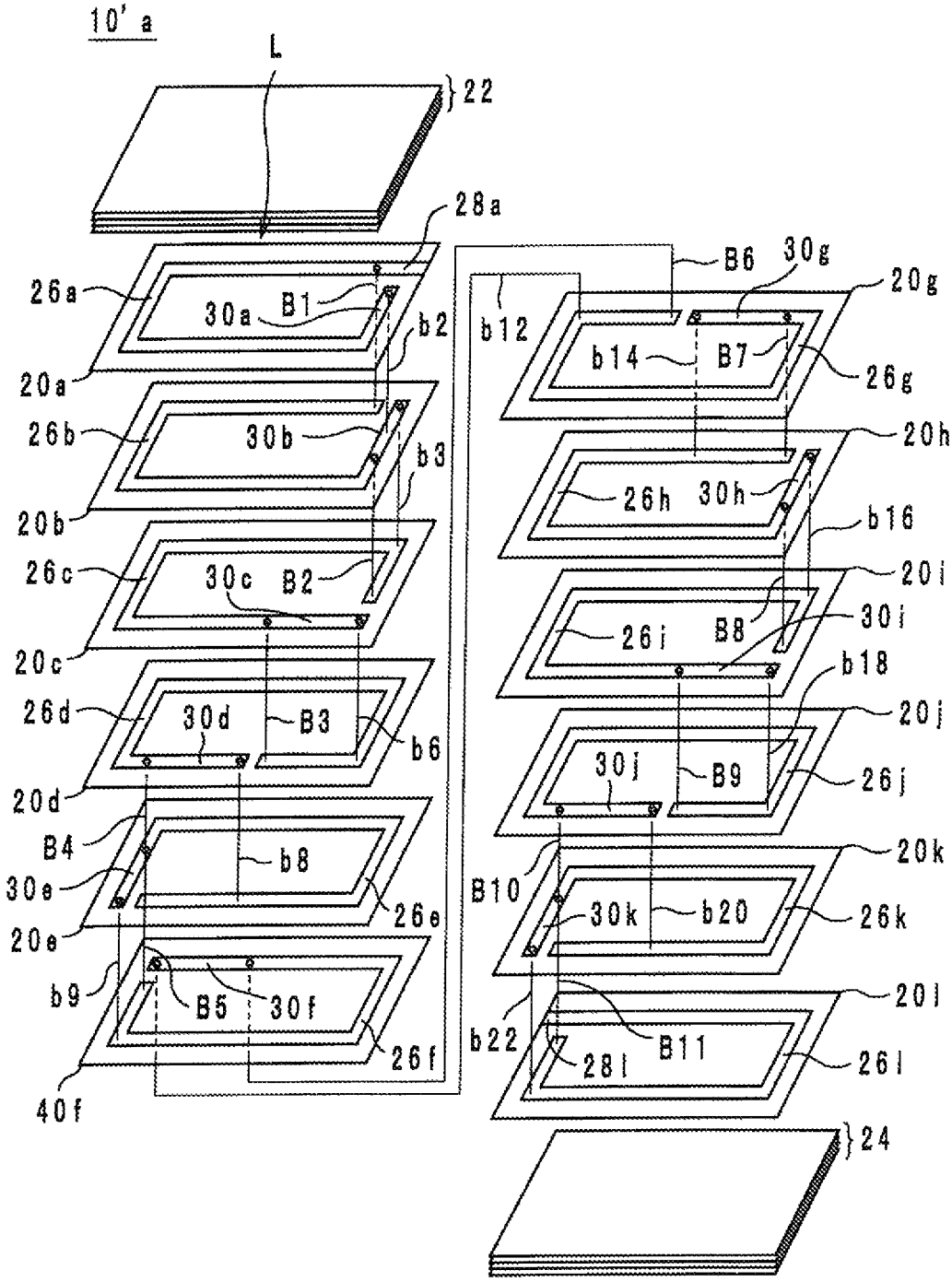
FIG. 8 is an exploded perspective view of a fourth prototype manufactured in the second experiment.

Next, the second experiment will be described with reference to the drawings. FIG. 7 is an exploded perspective view of a third prototype created for the second experiment. FIG. 8 is an exploded perspective view of a fourth prototype created for the second experiment. A chip-type coil component 10'*a* according to the fourth prototype shown in FIG. 8 has the same structure as that of the chip-type coil component 10' except that the number of turns of the coil L is different and except that the magnetic layer 20*f* is replaced with a non-magnetic layer 40*f*.

In the second experiment, in order to indicate an improvement in the direct-current superposition characteristics of the chip-type coil component 10' due to the auxiliary internal electrodes 30, a chip-type coil component without the auxiliary internal electrodes 30 laminated therein (i.e., the third prototype) shown in FIG. 7 and the chip-type coil component 10'*a* with the auxiliary internal electrodes 30 laminated therein (i.e., the fourth prototype) shown in FIG. 8 were created, and the resistances of the third prototype and the fourth prototype were measured.

In addition, the inductances (first inductances) and the induction efficiencies (first induction efficiencies) of the third prototype and the fourth prototype when no current is applied thereto and the inductances (second inductances) and the induction efficiencies (second induction efficiencies) of the third prototype and the fourth prototype when a current of 300 mA is applied thereto were measured.

First, the created chip-type coil components will be described. The third prototype and the fourth prototype have the following structures. The third prototype and the fourth prototype differ only in that the fourth prototype has the auxiliary internal electrodes 30.

Size: 2.00 mm×1.25 mm×0.85 mm

Material of magnetic layers: Ni—Cu—Zn based ferrite

Permeability of magnetic layers: 130

Material of non-magnetic layers: Cu—Zn based ferrite

Position of non-magnetic layers: one middle layer

Material of external electrodes: silver plated with nickel and tin

Material of internal electrodes and auxiliary internal electrodes: silver

Length of internal electrodes: ⅚ turns

The number of turns of coil L: 9.5 turns

Table 2 shows the inductances, the resistances, and the induction efficiencies of the third prototype and the fourth prototype having the above structures.

TABLE 2

| | Third prototype | Fourth prototype |
|---|---|---|
| Resistance (Ω) | 0.131 | 0.115 |
| First Inductance (μH) | 2.21 | 2.16 |
| First Induction Efficiency (μH/Ω) | 16.9 | 18.8 |
| Second Inductance (μH) | 1.55 | 1.68 |
| Second Induction Efficiency (μH/Ω) | 11.9 | 14.6 |
| Decreasing Rate (%) | −30 | −22 |

As shown by Table 2, when a current of 300 mA was applied to the third prototype, the inductance was reduced from its first inductance by 30%. In contrast, when a current of 300 mA was applied to the fourth prototype, the inductance was reduced from its first inductance only by 22%. Thus, it is found that the decreasing rate of the fourth prototype was lower than the decreasing rate of the third prototype. Accordingly, it is found that the provision of the auxiliary internal electrodes 30 improved the direct-current superposition characteristics of the chip-type coil component 10'*a*. In addition, according to the second experiment, it is supposed that the provision of the auxiliary internal electrodes 30 improves the direct-current superposition characteristics also in the chip-type coil components 10 and 10", as in the chip-type coil component 10'*a*.

Furthermore, the fourth prototype had better direct-current superposition characteristics than those of the third prototype. Accordingly, even while a current was applied, the inductance of the fourth prototype was higher than that of the third prototype. As a result, the second induction efficiency of the fourth prototype was higher than that of the third prototype. Consequently, it is found that the provision of the auxiliary internal electrodes 30 permitted the chip-type coil component 10'*a* to have an induction efficiency higher than that of the chip-type coil component 50 also while a current was applied.

In addition, it is supposed that the provision of the auxiliary internal electrodes 30 improves the induction efficiency in the state in which a current is applied also in the chip-type coil components 10 and 10", as in the chip-type coil component 10'*a*.

The method of manufacturing the chip-type coil component 10 will now be described with reference to FIGS. 1 and 2.

First, a ceramic green sheet to be used for the magnetic layers 20, 22, and 24 is manufactured in the following manner. For example, a raw material containing ferric oxide ($Fe_2O_3$), zinc oxide (ZnO), nickel oxide (NiO) and copper oxide (CuO) at 48.0 mol percent, 25.0 mol percent, 18.0 mol percent and 9.0 mol percent, respectively is subjected to wet mixing in a ball mill. After the resultant mixture is dried and milled, the resultant powder is calcined at 750° C. for one hour. The resultant calcined powder is subjected to wet milling in a ball mill, is dried, and is disintegrated, so that a ferrite ceramic powder is obtained.

A binder (for example, vinyl acetate or water-soluble acryl), a plasticizer, a humectant, and a dispersant are added to the ferrite ceramic powder and mixed together in a ball mill. The resultant mixture is defoamed by depressurization. The resultant ceramic slurry is formed into a sheet by a doctor blade method and is dried, so that a ceramic green sheet having a desired thickness is produced.

Next, the via-hole conductors B and b shown in FIG. 2 are formed in the ceramic green sheet to be used for the magnetic layers 20. Specifically, through holes are formed in the ceramic green sheet by applying a laser beam, etc. to the ceramic green sheet. The through holes are filled with a conductive paste made of Ag, Pd, Cu, Au, or an alloy thereof by, for example, a printing method. In this way, the via-hole conductors B and b are formed.

Then, a conductive paste is applied to the main surface of the ceramic green sheet having the via-hole conductors B and b formed therein by screen printing, photolithography, or another method, so that the internal electrodes 26 and the auxiliary internal electrodes 30 are formed.

Then, the ceramic green sheets are laminated to form an unfired mother multilayer body. In the lamination, the ceramic green sheets of a predetermined number are stacked to be temporarily pressure-bonded. After the temporary pressure-bonding is completed for all of the ceramic green sheets, permanent pressure-bonding is conducted on the mother multilayer body by using, for example, hydrostatic pressure.

Then, the unfired mother multilayer body is cut into individual multilayer bodies with a dicer or the like, so that the rectangular parallelepiped multilayer bodies are produced.

Then, debinding and sintering are conducted on each multilayer body, and the sintered multilayer body 12 is produced.

Then, an electrode paste mainly made of silver is applied to the surface of the multilayer body 12 by a known method, for example, an immersion method and is fired. In this way, the silver electrodes having the shape shown in FIG. 1 are formed.

Finally, the fired silver electrodes are plated with nickel and tin or solder, and thereby, the external electrodes 14*a* and 14*b* are finished. The chip-type coil component 10 shown in FIG. 1 is completed through the steps described above.

When one or more of the magnetic layers 20 are replaced with non-magnetic layers, it is necessary to manufacture a ceramic green sheet to be used for the non-magnetic layers. Specifically, such a ceramic green sheet is manufactured in the following manner. A raw material containing ferric oxide ($Fe_2O_3$), zinc oxide (ZnO) and copper oxide (CuO) at 48.0 mol percent, 43.0 mol percent and 9.0 mol percent, respectively is subjected to wet mixing in a ball mill. After the resultant mixture is dried and milled, the resultant powder is calcined at 750° C. for one hour. The resultant calcined powder is subjected to wet milling in a ball mill, is dried, and is disintegrated. In this way, a non-magnetic ceramic powder is obtained.

A binder (for example, vinyl acetate or water-soluble acryl), a plasticizer, a humectant, and a dispersant are added to the non-magnetic ceramic powder and are mixed together in a ball mill. The resultant mixture is defoamed by depressurization. The resultant ceramic slurry is formed into a sheet by a doctor blade method and is dried, so that a ceramic green sheet to be used for the non-magnetic layer is produced.

Although the sheet laminating method is described as the method of manufacturing the chip-type coil component 10, the method of manufacturing the chip-type coil component 10 is not restricted to the sheet lamination method. For example, the chip-type coil component 10 may be manufactured by, for example, sequential lamination or transfer lamination.

In addition, insulating layers made of, for example, polyimide may be used in the chip-type coil component 10, instead of the magnetic layers 20, 22, and 24, and the insulating layers may be produced by a combination of, for example, a film forming method such as thick-film printing, sputtering, chemical vapor deposition (CVD) and a photolithographic technique.

As described above, the present invention is useful for a chip-type coil component and, particularly, is excellent in that the resistance of the coil can be reduced while minimizing a decrease in the inductance of the coil.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A chip-type coil component, comprising:

a multilayer body including a plurality of insulating layers;

a plurality of internal electrodes laminated on the insulating layers and connected to each other to form a coil; and auxiliary internal electrodes laminated on the insulating layers on which the internal electrodes are laminated, wherein the auxiliary internal electrodes are provided on the insulating layers on which the internal electrodes are laminated, on a one-to-one basis, wherein each of the auxiliary internal electrodes is connected electrically in parallel to the internal electrode laminated on one of the insulating layers that is different from the insulating layer on which the auxiliary internal electrode is laminated, and wherein the auxiliary internal electrode and the internal electrode laminated on the same insulating layer are insulated from each other.

2. The chip-type coil component according to claim 1, wherein the auxiliary internal electrodes are arranged in an area where the plurality of internal electrodes are laminated, viewed from a lamination direction.

3. The chip-type coil component according to claim 1, wherein each of the auxiliary internal electrodes is connected to the internal electrode laminated on one of the insulating layers that is adjacent, in the lamination direction, to the insulating layer on which the auxiliary internal electrode is laminated.

4. The chip-type coil component according to claim 1, wherein the insulating layers are magnetic layers.

5. The chip-type coil component according to claim 1, wherein the auxiliary internal electrodes are arranged in an area where the plurality of internal electrodes are laminated, viewed from a lamination direction.

6. The chip-type coil component according to claim 1, wherein each of the auxiliary internal electrodes is connected to the internal electrode laminated on one of the insulating layers that is adjacent, in the lamination direction, to the insulating layer on which the auxiliary internal electrode is laminated.

7. The chip-type coil component according to claim 1, wherein the insulating layers are magnetic layers.

8. The chip-type coil component according to claim 2, wherein each of the auxiliary internal electrodes is connected to the internal electrode laminated on one of the insulating layers that is adjacent, in the lamination direction, to the insulating layer on which the auxiliary internal electrode is laminated.

9. The chip-type coil component according to claim 3, wherein the insulating layers are magnetic layers.

* * * * *